US006176327B1

(12) United States Patent
Hearn

(10) Patent No.: US 6,176,327 B1
(45) Date of Patent: Jan. 23, 2001

(54) METHOD AND TOOLSTRING FOR OPERATING A DOWNHOLE MOTOR

(75) Inventor: David D. Hearn, Anchorage, AL (US)

(73) Assignee: Atlantic Richfield Company, Los Angeles, CA (US)

( * ) Notice: Under 35 U.S.C. 154(b), the term of this patent shall be extended for 0 days.

(21) Appl. No.: 09/307,836

(22) Filed: May 10, 1999

(51) Int. Cl.[7] ..... E21B 7/08
(52) U.S. Cl. ..... 175/61; 175/38
(58) Field of Search ..... 175/41, 45, 46, 175/48, 40, 50, 61, 62, 27, 107, 322, 321, 73, 74, 317, 24, 38

(56) References Cited

U.S. PATENT DOCUMENTS

Re. 35,790 * 5/1998 Pustanyk et al. ..... 175/41 X
5,163,521 * 11/1992 Pustanyk et al. ..... 175/40
5,215,151 6/1993 Smith et al. .
5,311,952 5/1994 Eddison et al. .
5,339,913 8/1994 Rives .
5,529,133 * 6/1996 Eddison ..... 175/61
5,617,926 * 4/1997 Eddison et al. ..... 175/61
5,678,643 * 10/1997 Robbins et al. ..... 175/45

* cited by examiner

*Primary Examiner*—Robert E. Pezzuto

(57) ABSTRACT

A method and a toolstring for carrying out a downhole operation in a wellbore (e.g. milling a window in a well casing, drilling a lateral wellbore, etc.). The toolstring is comprised of a workstring and a downhole assembly which is comprised of a downhole, rotary motor (e.g. bent motor) for driving a cutting tool (e.g. carbide mill, drill bit, etc.) and a valve which is movable between a first position in which the flow of work fluid is blocked to the motor and a second position in which the fluid is now directed to the motor to thereby actuate the motor and drive the cutting tool. By initially blocking flow of fluid to the motor, certain functions can be performed within the wellbore (e.g. orienting the bent motor) before the motor begins any cutting within the wellbore.

16 Claims, 1 Drawing Sheet

METHOD AND TOOLSTRING FOR OPERATING A DOWNHOLE MOTOR

TECHNICAL FIELD

The present invention relates to a method and a toolstring for operating a downhole motor and in one aspect relates to a method and toolstring for operating a downhole, rotary motor for milling a window in a wellbore drilling a lateral wellbore.

BACKGROUND

Downhole "mud motors" have long been recognized as an economical tool for carrying out a variety of functions within a weilbore, e.g. milling a window in a well casing, drilling a lateral wellbore into a formation, etc. As will be understood in the art, a downhole mud motor is typically a positive displacement, hydraulic rotary motor which is lowered into a wellbore on the lower end of a toolstring and is actuated by pumping a power-fluid (e.g. drilling mud, water, etc.) down the toolstring and through the motor. As the fluid flows through the motor, it causes the motor to rotate at a speed which is proportional to the flow therethrough.

While mud motors offer several known advantages over more conventional rotary drilling methods in many applications, there are situations where their use may be detrimental. For example, downhole mud motors are commonly used with diamond mills (i.e. bits) to mill windows in cased wells and are then used to drill lateral bores or drainholes out into the surrounding formation through the milled window(s). Diamond mills are highly effective for this purpose but, as will be recognized, their use is relatively expensive. Recently, it has been proposed to use mills which have tungsten carbide cutting surfaces. These less-expensive, carbide mills actually perform more efficiently in many milling operations than do the diamond mills.

Unfortunately, however, carbide mills may actually cut too well when used with bent-sub, downhole motor combinations or with bent motors, the latter being a type of known downhole motor whose housing is bent at an angle along its length. The bend in the sub or the motor housing provides the side force needed by the mill to initiate a cut in the casing and also it establishes the direction in which the mill is to cut the window in the casing and which a lateral is to be drilled.

Known toolstrings commonly used in carrying out such milling/drilling operations are typically made-up of the following: a workstring which extends into the well from the surface and a downhole assembly carried on the lower end of the workstring. The downhole assembly, in turn, is basically made-up of at least (a) a bent-sub, downhole motor combination or a bent-housing motor (hereinafter collectively called "bent motor"); (b) a mill/bit connected to the output of the motor; (c) a sensor for detecting the azimuth of the bent motor and generating data representative thereof; and (d) a means for transmitting the azimuth data to the surface. As will be understood in the art, this latter means may comprise either a cable (e.g. E-line) extending to the surface or a measurement-while-drilling {MWD} tool which transmits data through the liquid column in the wellbore.

Where rigid drill pipe is used as the workstring to lower the downhole assembly, the bent motor may be rotated to its desired azimuth/direction as determined by the downhole data by merely rotating the rigid workstring at the surface. However, recently, coiled tubing is used more and more as the workstring in such operations. As will be understood in the art, "coiled tubing" is a continuous length of a relatively small diameter (e.g. ¾–3½ inch), thin-walled metal tubing (e.g. steel, etc.) which can be wound or coiled onto a reel or spool and which can be paid out or reeled in without having to make-up or break-out individual stands of pipe. Coiled tubing is well known in the art and is readily available in the field. However, since the tubing is coiled onto a reel, it can not readily be rotated from the surface as will be understood in the art. Accordingly, the downhole assembly must now also include an orienting tool (i.e. "orienter") which can be manipulated from the surface to orient the bent motor to its desired azimuth/direction before the milling/drilling operation can be carried out.

In a window-milling operation, a toolstring, such as described, above is lowered down a well until the mill on the lower end of the bent motor is at the depth at which the window is to be milled in the well casing. A work-fluid (e.g. drilling mud, water, etc.) is circulated down the workstring and through the downhole assembly (e.g. an orienter, MWD tool, and a bent motor). The fluid flows out of the motor, through the mill, and back to the surface through the annulus formed between the well casing and the tool string.

Once the mill is at the desired depth, the work-fluid has to be circulated through the downhole assembly for several minutes before the actual cutting of the window can begin in order to (1) sense the azimuth/direction in which the bent motor and mill are initially pointed; (2) transmit that data indicative of the sensed direction to the surface by means of the MWD tool; and (3) cycle the work-fluid pumps at the surface to cause the orienter to rotate (i.e. ratchet) the bent motor around to the desired direction.

Unfortunately, the work-fluid also flows through and powers the motor during the time it takes to orient the bent motor. This is not usually considered a serious problem where diamond mills are being used because diamond mills are slow to initiate the cut required in milling a window. Accordingly, rotation of a diamond mill during the orienting of the bent motor will cause little, if any, damage in the wellbore.

However, since carbide mills can cut much faster than diamond mills, rotation of the mill (i.e. powering the downhole motor) while orienting the bent motor can cause substantial damage to (a) the cement plug normally present in the wellbore, (b) the liner or casing, and (c) even to the mill, itself, before the mill is properly oriented in the well. To alleviate this problem, it has been proposed to coat the cutting surfaces of carbide mills with a relatively soft, sacrificial metal (e.g. brass, lead, etc.) which is designed to wear away and eventually allow the desired carbide cutting surfaces to become exposed.

In practice, however, it is difficult to place the right amount of this metal in just the right spots to insure that the sacrificial metal will wear consistently. That is, sometimes the sacrificial metal wears away faster than expected or the orientation period takes longer than anticipated thereby resulting in damage due to early exposure of the cutting surfaces of the rotating mill. In other instances, the sacrificial metal never completely wears off of the cutting surfaces thereby interfering with the initiation of the cut required to successfully mill a window in the wellbore.

SUMMARY OF THE INVENTION

The present invention provides a method and a toolstring for carrying out a downhole operation in a wellbore (e.g. milling a window in a well casing, drilling a lateral wellbore, etc.). The toolstring is comprised of a workstring which is adapted to extend from the surface and a downhole assembly which is connected to the lower end of said workstring. The downhole assembly is basically comprised of a downhole, rotary motor (e.g. bent motor) for driving a cutting tool (e.g. carbide mill, drill bit, etc.) and a flow control valve unit which is movable between a first position in which fluid flowing down the workstring is blocked from flowing through the downhole, rotary motor and a second position in which the fluid is directed through the downhole, rotary motor to thereby actuate the motor and drive the cutting tool. By initially blocking flow of fluid to the downhole motor, certain functions can be performed within the wellbore (e.g. orienting the downhole bent motor) before the motor is actuated to commence the cutting operations.

More specifically, the downhole assembly of the present invention also includes a directional sensing and data transmitting tool (e.g. an MWD tool) for determining the direction of said bent motor and for transmitting data representative thereof to the surface and an orienter for orienting the bent motor to a desired direction within said wellbore. The flow control valve unit is positioned below both the MWD tool and the orienter but above the bent motor.

The flow control valve unit has a slidable valve element therein which, when in a first position, directs flow in the workstring through a by-pass outlet while blocking flow to the bent motor and, when in a second position, directs the work fluid to the bent motor while blocking flow through the by-pass outlet. A releasable means (e.g. shear pin) holds the valve element in its first position until the bent motor has been oriented to its desired direction.

In operation, the workstring having thereon a downhole assembly comprised of a data sensing and transmission tool (e.g. MWD tool), an orienter, flow control valve unit, and a bent motor having a mill thereon is lowered down a wellbore. A work fluid is pumped down the workstring and through (a) the MWD tool to thereby sense the position of the bent motor and transmit this data to the surface; (b) the orienter to thereby orient said bent motor to its desired position; and (c) a by-pass outlet in said fluid control valve unit. Once the bent motor has been properly oriented, the pressure of the work fluid is increased to move the fluid control valve unit to its second position to thereby block the by-pass and direct the fluid to the bent motor to actuate said motor and drive said mill to thereby mill a window in the well casing.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
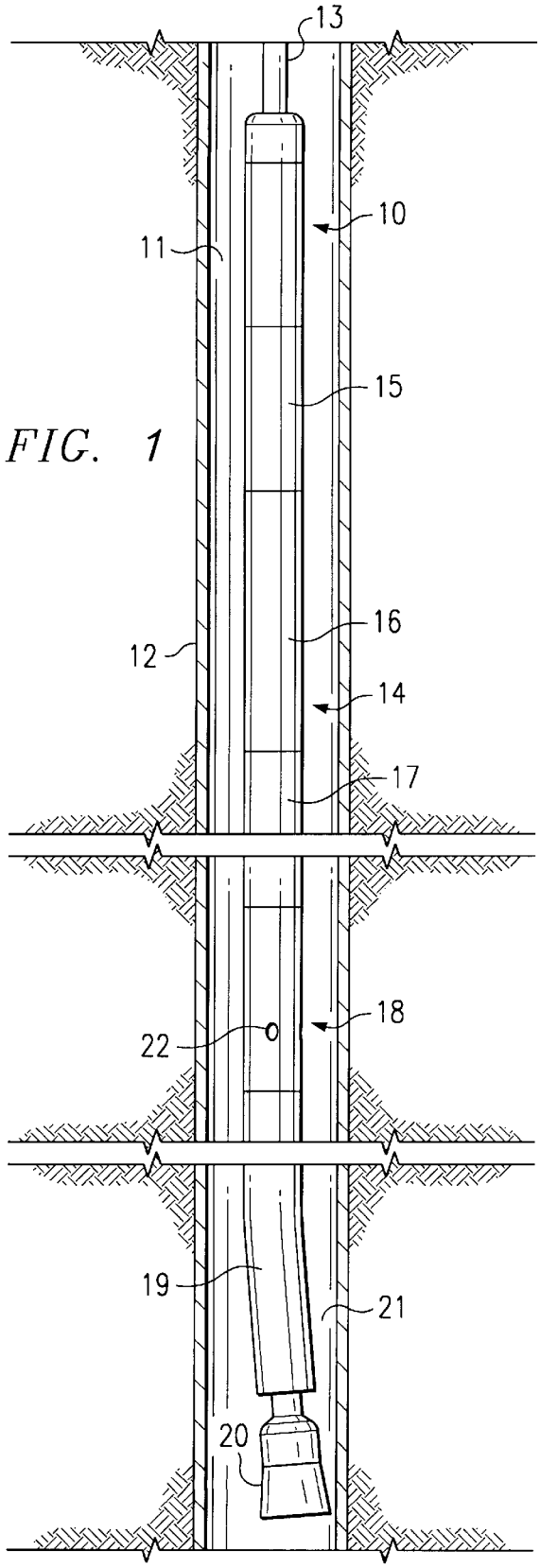
FIG. 1 illustrates a toolstring having a downhole assembly in accordance with the present invention positioned in an operable position within a wellbore.

Referring more particularly to the drawings, FIG. 1 illustrates a toolstring 10 in accordance with the present invention when in an operable position within cased wellbore 11, which, in turn, has been shown as being cased with casing 12. While wellbore 11 has been shown and described in relation as being vertical wellbore cased with casing 12, it should be understood that the present invention also can be used in carrying out operations in wells which have been completed differently (e.g. open-hole, liners, etc.) as well as in wells having horizontal or deviated boreholes.

As illustrated, toolstring 10 is comprised of a workstring 13 extending from the surface (not shown) and downhole assembly 14 which is connected to the lower end thereof. While workstring 13 may be comprised of rigid pipe (e.g. regular steel drill pipe), preferably it is comprised of coiled Lubing. Coiled tubing, as will be understood in the art, is a continuous length of a relatively small diameter (e.g. ¾–3½ inch), thin-walled metal tubing (e.g. steel, etc.) which can be wound or coiled onto a reel or spool. Such tubing is well known and is readily available in the field.

As shown, downhole assembly 14 is comprised of a quick-disconnect sub 15, an orienting tool ("orienter" 16), a direction or azimuth sensing and data transmission tool 17, a flow control valve unit 18, and a bent motor 19. Quick-disconnect sub 15, the details of which form no part of the present invention, may be any of several which are commercially-available and which are commonly used in toolstrings of type to allow the workstring 13 to be easily disconnected and retrieved to the surface in the event the downhole assembly 14 becomes stuck in the hole.

Orienter 16 is one which is capable of being operated from the surface to sequentially rotate downhole assembly 14 below orienter 16 with respect to the non-rotating, workstring 13 until the bent motor carried by the lower portion of the orienter is properly oriented (i.e. pointed in the right direction). Preferably, orienter 16 is of the type which is hydraulically-actuated by pulsing the work-fluid pumps (not shown) at the surface. That is, the pump pressure is relaxed which allows a first part of the orienter to move upward relative to the lower part of the orienter to "cock" the orienter and then move downward to "ratchet" the lower part of the orienter around towards the desired azimuth/direction each time the pump pressure is increased after relaxation.

Such orienters are well known in the art, see U.S. Pat. No. 5,215,151, issued Jun. 1, 1993, and U.S. Pat. No. 5,311,952, issued May 17, 1994, both of which are incorporated herein in their entirety by reference. These types of orienters are now commonly used in the field and are commercially-available from several suppliers and/or service contractors. Of course, if rigid pipe is used as workstring 13 in place of coiled tubing, an orienter 16 would not be needed in the downhole assembly since bent motor 19 could then be rotated to the desired direction by merely rotating workstring 13 at the surface.

Direction sensing and data transmission tool 17 (hereinafter called "data tool 17") may be any of several well known data tools commonly-used in carrying out similar downhole operations and which are readily commercially-available from a variety of service contractors. For example, data tool 17 may be a "steering tool" with the sensed, directional data being transmitted to the surface through a hard line or cable (e.g. an E-line, not shown) or the like. For such a downhole assembly, see U.S. Pat. No. 5,215,151, issued Jun. 1, 1993. Preferably, however, data tool 17 is comprised of a measurement-while-drilling (MWD) tool which senses the direction of the bent motor 19 and transmits the data to the surface via signals imparted into the column of work-fluid which fills the toolstring 10. There are known MWD tools which transmit the signals on a continuous wave within the fluid while others transmit the signals as pulses in the fluid. For an example of such a tool, see U.S. Pat. No. 5,311,952 and the description therein.

Bent motor 19 , as used herein, is meant to include both a bent sub-motor combination or a motor having a housing which is bent at an angle along its length. Bent motor 19 is typically a hydraulically-driven, rotary motor which is of the type universally known in the directional drilling art and which is readily available from a variety of commercial sources (e.g. Baker-Hughes Inteq, Houston, Tex.). For example, motor 19 may be a "Moyno"-type, positive displacement device which has a spiral-ribbed rotor which rotates within a lobed stator. When a work fluid (e.g. drilling mud, water, etc.) is pumped through the motor, the rotor turns and drives an output shaft which is connected either directly or indirectly to a cutting tool 20 (e.g. a window mill, drill bit, etc.).

A toolstring, as described up to this point, is basically known in the prior art and has been used to carry out drilling/milling operations in a wellbore; again see U.S. Pat. Nos. 5,215,151 and 5,311,952, both of which have been incorporated herein by reference. The operation of this type of toolstring is as follows. A work fluid (e.g. drilling mud, water, etc.) is pumped down workstring 13 (e.g. coiled tubing) from the surface and flows through orienter 16, data tool 17, through bent motor 19, out through mill/drill 20 and back to the surface through annulus 21. Data tool 17 senses the direction in which bent motor 20 is pointed and transmits this information back to the surface either through the mud if an MWD tool is being used or through an E-line if an electrical steering tool is being used.

Upon receipt of the directional data at the surface, the pump pressure of the work fluid is first relaxed and then increased to actuate orienter 16 to ratchet bent motor 19 around to the desired azimuth/direction. Unfortunately, in such prior-art toolstrings, the work fluid is also flowing through bent motor 19 and is driving the mill/drill 20 during the time the bent motor 19 is being oriented. Where mill 20 is a diamond mill, its rotation by motor 19 will normally cause little, if any damage to the cement plug (not shown but which will typically be present in the wellbore) or to casing 12 or other completion tubular (e.g. liner). However, where mill 20 is a preferred carbide mill, its rotation prior to the proper orientation of bent motor 19 can cause serious damage within the wellbore; e.g. initiate a cut in casing 12 before the bent motor is aligned in the desired azimuth/direction.

To prevent the driving of bent motor 19 before it is properly oriented, the downhole assembly 14 of toolstring 10 of the present invention includes a flow control valve unit 18 which is positioned within the downhole assembly below data tool 17. Basically, flow control valve unit 18 is a valve which, when in a first position, allows the work fluid flowing down workstring 13 to exit through by-pass outlet port(s) 22 and into well annulus 21 before the work fluid can flow through bent motor 19. The work fluid still flows through both orienter 16 and data tool 17 (e.g. MWD tool) so that (a) the azimuth/direction of bent motor 19 can be determined, (b) the data representative thereof can be transmitted to the surface, and (c) orienter 16 can be operated using this data to properly orient bent motor 19. Once bent motor 19 has been properly oriented, the pressure of the work fluid is increased to and maintained at a value which will move the valve mechanism of flow control valve unit 18 to a second position, in which by-pass outlet port(s) 22 are now closed and the work fluid is directed through bent motor 19 to drive same and rotate mill 20.

Figure 2:
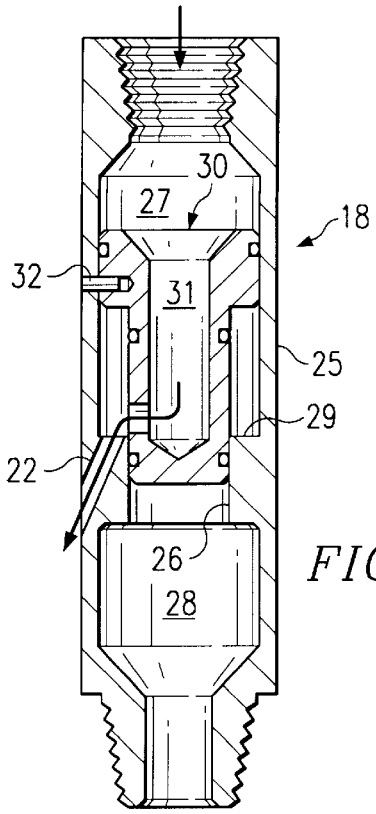
FIG. 2 is an enlarged, sectional view of one modification of the flow control valve unit which forms part of the downhole assembly of FIG. 1 when said flow control valve unit is in a first position.

Referring now particularly to FIG. 2, as illustrated, flow control tool 18 is comprised of a housing 25 which has an inlet connected (e.g. threaded) at its upper end to the lower end of data tool 17 and a main outlet at its lower end which is connected to bent motor 19. Housing 25 has a bore 26 therethrough which is divided into an upper chamber 27 and a lower chamber 28 by an internal shoulder 29 or the like. By-pass outlet port(s) 22 are in fluid communication with upper chamber 27.

Figure 3:
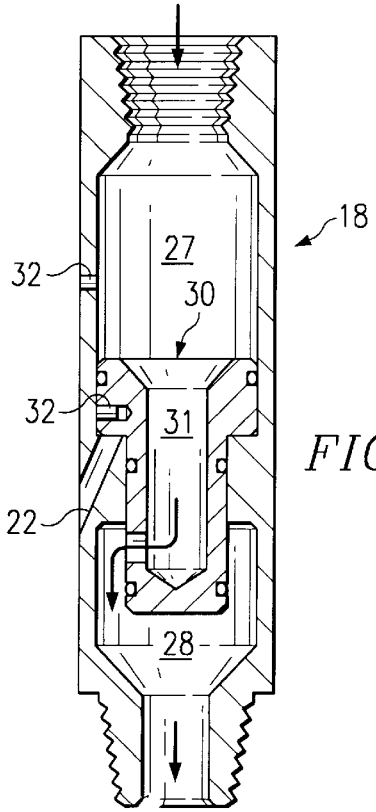
FIG. 3 is another sectional view of the flow control valve unit of FIG. 2 when said flow control valve unit is in a second position.

Valve element 30, having a fluid passage 31 therethrough, is slidably positioned within bore 26 and is movable between a first position (FIG. 2) and a second position (FIG. 3). Valve element 30 is initially secured in the first position within housing 25 by a shear pin 32 so that the fluid passage 31 in valve element 30 will open into upper chamber 27. The work fluid, after flowing through data tool 17 (FIG. 1) will flow into the upper chamber 27 of flow control tool 18, through passage 31 of valve element 30, and out by-pass outlet port(s) 22 in housing 25.

Once the bent sub 19 is properly oriented, the pressure of the work fluid is increased which, in turn, acts on element 30 to shear the shear pin 32 and move element 30 to its second position (FIG. 3). In this second position, the upper portion of element 30 blocks flow through by-pass outlet port(s) 22 while passage 31 now opens into chamber 28, hence into bent motor 19. Flow control valve unit 18 operates similarly to those commercially-available valves commonly known as "flow actuated inflation valves" and which are typically used in running and setting packers in a borehole; e.g. those available from Baker Oil Tools; Dowell-Ciot, and others. In these known valve mechanisms, the valve is locked in the second position once it has been moved to the second position by an increase in the pressure of the work fluid.

It can be seen that by being able to delay activating the bent motor 19 until it has been properly oriented, several advantages can be realized, e.g. carbide mills can be readily used without running the risk of damaging the wellbore during a window-milling operation.

What is claimed is:

1. A toolstring for carrying out a downhole operation in a wellbore, said toolstring comprising:

a workstring adapted to extend from the surface into said wellbore; and a downhole assembly connected to the lower end of said workstring, said downhole assembly comprising:

a downhole, rotary motor for driving a cutting tool; and a flow control valve unit movable between a first position in which fluid flowing down said workstring is blocked from flowing through said downhole, rotary motor and a second position in which said fluid flowing down workstring is directed through said downhole, rotary motor to drive same.

2. The toolstring of claim 1 wherein said downhole, rotaty motor comprises a bent motor for directing said bit in a lateral direction from said wellbore;

and wherein said downhole assembly includes:

a directional sensing and data transmitting tool for determining the direction of said bent motor and transmitting data representative thereof to the surface.

3. The toolstring of claim 2 wherein said directional sensing and data transmitting tool is an electrical steering tool which senses the direction of said bent motor and transmits said data to the surface through a cable.

4. The toolstring of claim 2 wherein said directional sensing and data transmitting tool is a measurement-while-drilling (MWD) tool which senses the direction of said bent motor and transmits said data to the surface through a column of liquid in said wellbore.

5. The toolstring of claim 4 wherein said downhole assembly includes:

an orienter for orienting said bent motor to a desired direction within said wellbore.

6. The toolstring of claim 5 wherein said flow control valve unit is positioned below said directional sensing and data transmission tool and said orienter and above said bent motor.

7. The toolstring of claim 6 wherein said flow control valve unit comprises:

a housing having an inlet fluidly connected to said workstring, a by-pass outlet, and main outlet fluidly connected to said bent motor;

a valve element slidably mounted in said housing, said valve element when in a first position directs flow from said inlet through said by-pass outlet while blocking flow through said main outlet and when in a second position directs flow from said inlet through said main outlet while blocking flow through said by-pass outlet.

8. The toolstring of claim 7 wherein said flow control valve unit using further includes:

releasable means for holding said valve element in said first position until said bent motor is positioned in its desired direction.

9. The toolstring of claim 8 wherein said releasable means comprises:

a shear pin.

10. The toolstring of claim 6 wherein said bit comprises:

a carbide mill for milling a window in a well casing.

11. A method for operating a downhole, bent motor to carry out a desired operation in a wellbore, said method comprising:

lowering a workstring into said wellbore, said workstring having said bent motor on the lower end thereof;

orienting said bent motor to its desired azimuth before actuating said bent motor; and actuating said bent motor after it has been oriented to carrying out said desire downhole operation.

12. The method of claim 11 wherein the step of orienting said bent motor comprises:

sensing the direction of said bent motor;

transmitting data representative of said direction to the surface; and rotating said bent motor to its desired position within said wellbore as determined from said data.

13. The method of claim 12 wherein said operation comprises:

milling a window in a well casing within said wellbore.

14. The method of claim 12 wherein said operation comprises:

drilling a lateral wellbore from said wellbore.

15. A method for milling a window in a casing which is positioned within a wellbore, said method comprising:

lowering a workstring down said wellbore, said wellbore having a downhole assembly on the lower end thereof, said downhole assembly comprised of a measurement-while-drilling (MWD) tool, an orienter, a fluid control valve unit having a first and a second position, and a rotary, bent motor having a mill drivingly connected thereto;

flowing a work fluid down said workstring and through (a) said MWD tool to sense the position of said bent motor and transmit said data to said surface through said work fluid in said workstring;

(b) said orienter to thereby orient said bent motor in a desired position within said wellbore as determined by said data; and (c) a by-pass outlet in said fluid control valve unit while said fluid control valve unit is in said first position;

moving said fluid control valve unit from said first position to said second position when said bent motor has been oriented to said desired position to thereby block the flow of the work fluid through said by-pass and direct the flow of work fluid through said bent motor to actuate said motor and drive said mill to thereby mill said window in said casing.

16. The method of claim 15 wherein said fluid control valve unit is moved from said first to said second position by increasing the pressure of the work fluid in said workstring after said bent motor has been oriented.

* * * * *